US005531933A

United States Patent [19]

Masters et al.

[11] Patent Number: 5,531,933

[45] Date of Patent: Jul. 2, 1996

[54] LIQUID HARD SURFACE DETERGENT COMPOSITIONS CONTAINING SPECIFIC POLYCARBOXYLATE DETERGENT BUILDERS

[75] Inventors: Ronald A. Masters, Loveland; Michael S. Maile, Maineville; David C. Underwood, Cincinnati; Michael J. Kupneski, Maineville; Timothy C. Roetker, Fairfield, all of Ohio

[73] Assignee: The Procter & Gamble Company, Cincinnati, Ohio

[21] Appl. No.: 294,256

[22] Filed: Aug. 23, 1994

Related U.S. Application Data

[63] Continuation-in-part of Ser. No. 175,832, Dec. 30, 1993, abandoned.

[51] Int. Cl.[6] ..... C11D 1/12; C11D 1/92; C11D 3/33; C11D 3/30

[52] U.S. Cl. ..... 510/429; 510/494; 510/181; 510/182; 510/432; 510/434; 510/537; 510/506

[58] Field of Search ..... 252/545, 546, 252/153, 554, 558, 559, 174.19, 174.21, DIG. 10, DIG. 11, 156, 550, 548

[56] References Cited

U.S. PATENT DOCUMENTS

| | | | |
|---|---|---|---|
| 2,528,378 | 10/1950 | Mannheimer | 260/309.6 |
| 3,280,179 | 10/1966 | Ernst | 260/501 |
| 3,309,321 | 3/1967 | McMaster | 252/152 |
| 3,539,521 | 11/1970 | Snoddy et al. | 252/137 |
| 3,649,569 | 3/1972 | McCarty | 252/543 |
| 3,696,043 | 10/1972 | Labarge et al. | 252/153 |
| 3,755,559 | 8/1973 | Hewitt | 424/70 |
| 3,840,480 | 10/1974 | Barrat et al. | 252/545 |
| 3,842,847 | 10/1974 | Hewitt et al. | 132/7 |
| 3,849,548 | 11/1974 | Grand | 424/70 |
| 3,925,262 | 12/1975 | Laughlin et al. | 252/526 |
| 3,928,065 | 12/1975 | Savino | 134/7 |
| 3,928,251 | 12/1975 | Bolich, Jr. et al. | 252/545 |
| 3,935,130 | 1/1976 | Hirano et al. | 252/542 |
| 3,950,417 | 4/1976 | Verdicchio et al. | 252/545 |
| 3,962,418 | 6/1976 | Birkofer | 424/70 |
| 4,081,395 | 3/1978 | Talley | 252/106 |
| 4,110,263 | 8/1978 | Lindemann et al. | 252/545 |
| 4,122,043 | 10/1978 | Kersnar et al. | 252/527 |
| 4,148,762 | 4/1979 | Koch et al. | 252/544 |
| 4,181,634 | 1/1980 | Kennedy et al. | 252/545 |
| 4,186,113 | 1/1980 | Verdicchio et al. | 252/526 |
| 4,214,908 | 7/1980 | Deguchi et al. | 106/13 |
| 4,233,192 | 11/1980 | Lindemann et al. | 252/545 |
| 4,246,131 | 1/1981 | Lohr | 252/153 |
| 4,257,907 | 3/1981 | Lagguth et al. | 252/106 |
| 4,259,217 | 3/1981 | Murphy | 252/547 |
| 4,261,869 | 4/1981 | Bishop et al. | 252/542 |
| 4,265,782 | 5/1981 | Armstrong et al. | 252/174.19 |
| 4,299,739 | 11/1981 | Esposito et al. | 252/545 |
| 4,329,334 | 5/1982 | Su et al. | 424/70 |
| 4,329,335 | 5/1982 | Su et al. | 424/70 |

(List continued on next page.)

FOREIGN PATENT DOCUMENTS

| | | | |
|---|---|---|---|
| 88168 | 9/1982 | Australia | C11D 10/04 |
| 706409 | 3/1965 | Canada | 260/309.6 |
| 706408 | 3/1965 | Canada | 260/309.6 |
| 0004755A1 | 10/1979 | European Pat. Off. | C11D 1/94 |
| 0024031A1 | 2/1981 | European Pat. Off. | C11D 1/90 |
| 0040882A2 | 12/1981 | European Pat. Off. | C11D 3/16 |
| 0067635A2 | 12/1982 | European Pat. Off. | A61K 7/08 |
| 0106266A2 | 4/1984 | European Pat. Off. | C11D 3/43 |
| 0117135A2 | 8/1984 | European Pat. Off. | C11D 3/37 |
| 0205626 | 5/1985 | European Pat. Off. | C07C 143/14 |
| 0157443A1 | 10/1985 | European Pat. Off. | C11D 1/83 |
| 0181212A1 | 5/1986 | European Pat. Off. | C11D 1/94 |
| 0338850 | 10/1989 | European Pat. Off. | A61K 7/075 |
| 0373851A2 | 6/1990 | European Pat. Off. | C11D 1/94 |

(List continued on next page.)

OTHER PUBLICATIONS

N. Parris et al., "Soap Based Detergent Formulations. V. Amphoteric Lime Soap Dispersing Agents," JAOCS, 50(1973) pp. 509–512 no month available.

W. R. Noble et al., "Soap–Based Detergent Formulations: X. Nature of Detergent Deposits," JAOCS, 52(1975) pp. 1–4 no month available.

N. Parris et al., "Soap–Based Detergent Formulations: XII. Alternate Syntheses of Surface Active Sulfobetaines," JAOCS, 53(1976) pp. 60–63 no month available.

F. D. Smith et al., "Soap–Based Detergent Formulations: XV. Amino Esters of alpha–Sulfo Fatty Acids," JAOCS, 53(1976) pp. 69–72.

Parris et al., "Soap–Based Detergent Formulations: XVIII. Effect of Structure Variations on Surface–Active Properties of Sulfur Containing Amphoteric Surfactants", JAOCS, 53(1976) pp. 97–100 no month available.

J. K. Weil et al., "Soap–Based Detergent Formulations: XX. The Physical and Chemical Nature of Lime Soap Dispersions," JAOCS, 53(1976) pp. 757–761 no month available.

J. K. Weil et al., "The Mutual Solubilization of Soap and Lime Soap Dispersing Agents," JAOCS, 54(1977) pp. 1–3 no month available.

T. J. Micich et al., "Soap–Based Detergent Formulations: XIX. Amphoteric Alkyl–succinamide Derivatives as Lime Soap Dispersants," JAOCS, 54(1977) pp. 91–94 no month available.

(List continued on next page.)

*Primary Examiner*—Erin M. Harriman

*Attorney, Agent, or Firm*—Robert B. Aylor; Jacobus C. Rasser

[57] ABSTRACT

Aqueous, liquid hard surface detergent compositions having improved cleaning and good filming/streaking characteristics contain specific polycarboxylate detergent builders at critical levels. Preferred formulas contain a zwitterionic/anionic detergent surfactant mixture at levels (e.g., from about 0.02 to about 15%); hydrophobic solvent; alkaline material, especially volatile alkaline materials comprising monoethanolamine or certain beta-amino-alkanol compounds; and salt of ethylenediaminetetraacetic acid as the detergent builder in levels (e.g., from about 0.05% to about 0.5%, by weight of the composition).

8 Claims, No Drawings

U.S. PATENT DOCUMENTS

| | | | |
|---|---|---|---|
| 4,372,869 | 2/1983 | Lindemann et al. | 252/174.16 |
| 4,396,525 | 8/1983 | Tubin et al. | 252/174 |
| 4,414,128 | 11/1983 | Goffinet | 252/111 |
| 4,420,484 | 12/1983 | Gorman et al. | 424/326 |
| 4,438,096 | 3/1984 | Preston | 424/70 |
| 4,443,362 | 4/1984 | Guth et al. | 252/545 |
| 4,450,091 | 5/1984 | Schmolka | 252/174.21 |
| 4,452,732 | 6/1984 | Bolich, Jr. | 252/547 |
| 4,477,365 | 10/1984 | Verboom et al. | 252/156 |
| 4,485,029 | 11/1984 | Kato et al. | 252/106 |
| 4,529,588 | 7/1985 | Smith et al. | 424/70 |
| 4,554,098 | 11/1985 | Klisch et al. | 252/547 |
| 4,654,207 | 3/1987 | Preston | 424/70 |
| 4,673,523 | 6/1987 | Smith et al. | 252/91 |
| 4,683,008 | 7/1987 | Betts | 134/27 |
| 4,690,779 | 9/1987 | Baker et al. | 252/546 |
| 4,692,277 | 9/1987 | Siklosi | 252/558 |
| 4,698,181 | 10/1987 | Lewis | 252/527 |
| 4,769,169 | 9/1988 | Fishlock-Lomax | 252/106 |
| 4,769,172 | 9/1988 | Siklosi | 252/153 |
| 4,772,424 | 9/1988 | Greeb | 252/546 |
| 4,784,786 | 11/1988 | Smith et al. | 252/91 |
| 4,810,421 | 3/1989 | Marchesini | 252/546 |
| 4,824,605 | 4/1989 | Hildreth . | |
| 4,913,841 | 4/1990 | Zeman | 252/352 |
| 4,921,629 | 5/1990 | Malihi et al. | 252/170 |
| 4,948,531 | 8/1990 | Fuggini et al. | 252/544 |
| 5,015,412 | 5/1991 | Zeman | 252/311 |
| 5,061,393 | 10/1991 | Linares et al. | 252/170 |
| 5,108,660 | 4/1992 | Michael | 252/545 |
| 5,252,245 | 10/1993 | Garabedian, Jr. et al. | 252/153 |
| 5,290,472 | 3/1994 | Michael | 252/170 |
| 5,336,445 | 8/1994 | Michael et al. | 252/548 |
| 5,342,549 | 8/1994 | Michael | 252/546 |
| 5,350,541 | 9/1994 | Michael et al. | 252/549 |
| 5,362,422 | 11/1994 | Masters | 252/544 |
| 5,376,298 | 12/1994 | Michael | 252/153 |
| 5,382,376 | 1/1995 | Michael et al. | 252/153 |

FOREIGN PATENT DOCUMENTS

| | | | |
|---|---|---|---|
| 0408174A1 | 1/1991 | European Pat. Off. | A61K 7/16 |
| 0527625A2 | 2/1993 | European Pat. Off. | C11D 3/43 |
| 275046A1 | 11/1982 | German Dem. Rep. | C07D 207/08 |
| 274332A3 | 11/1982 | German Dem. Rep. | C07C 143/15 |
| 2336449 | 7/1973 | Germany | C11D 1/83 |
| 3610395A1 | 10/1987 | Germany | A61K 7/50 |
| 4210364A1 | 3/1992 | Germany | C11D 3/20 |
| 48-60706Q | 8/1973 | Japan . | |
| 59-189197A | 10/1984 | Japan | C11D 1/94 |
| 60-141797A | 7/1985 | Japan | C11D 1/94 |
| 60-161498A | 8/1985 | Japan | C11D 1/94 |
| 60-195200A | 10/1985 | Japan | C11D 1/94 |
| 61-014296A | 1/1986 | Japan | C11D 3/14 |
| 61-014298A | 1/1986 | Japan | C11D 3/43 |
| 61-009500A | 11/1986 | Japan | C11D 1/88 |
| 62-257992A | 11/1987 | Japan | C11D 3/60 |
| 63-012333A | 1/1988 | Japan | B01F 17/16 |
| 01153796A | 6/1989 | Japan | C11D 1/94 |
| 01221496A | 9/1989 | Japan | C11D 1/02 |
| 01221497A | 9/1989 | Japan | C11D 1/62 |
| 02269200A | 11/1990 | Japan | C11D 1/94 |
| 02296899A | 12/1990 | Japan | A61K 7/07 |
| 03163052A | 7/1991 | Japan | C07C 233/47 |
| 03153797A | 7/1991 | Japan | C11D 1/88 |
| 03215410A | 9/1991 | Japan | A61K 7/07 |
| 03258900A | 11/1991 | Japan | A61K 7/07 |
| 84944A | 10/1984 | Romania | A61K 7/06 |
| 1544563 | 4/1979 | United Kingdom | C11D 1/94 |
| 2114996 | 9/1983 | United Kingdom | C11D 1/94 |
| 2193505 | 2/1988 | United Kingdom | C11D 3/33 |
| WO9109104A | 6/1991 | WIPO | C11D 7/32 |
| WO9109930A | 7/1991 | WIPO | C11D 1/38 |
| WO9113610 | 9/1991 | WIPO | A61K 7/50 |
| WO9115192 | 10/1991 | WIPO | A61K 7/50 |
| 9205234 | 4/1992 | WIPO . | |

OTHER PUBLICATIONS

T. J. Micich et al., "Soap–Based Detergent Formulations: XXII. Sulfobetaine Derivatives of N–Alkylglutaramides and Adipamides," JAOCS, 54(1977) pp. 264–266 no month available.

N. Parris et al., "Soap–Based Detergent Formulation: XXIV. Sulfobetaine Derivatives of Fatty Amides," JAOCS, 54(1977), pp. 294–296 no month available.

J. K. Weil et al., "Surface Active Properties of Combinations of Soap and Lime Soap Dispersing Agents," JAOCS, 54(1976) pp. 339–342 no month available.

J. M. Kaminski et al., "Soap–Based Detergent Formulations: XXIII. Synthesis of p–Sulfobenzyl Ammonium Inner Salts and Structural Correlation with Analogous Amphoterics," JAOCS, 54(1977) pp. 516–520 no month available.

F. D. Smith et al., "Soap–Based Detergent Formulations: XXI. Amphoteric Derivatives of Fatty Amides of Aminoethylethanolamine," JAOCS, 55(1978) pp. 741–744 no month available.

J. M. Kaminski et al., "Soap–Based Detergent Formulations: XXV. Synthesis and Surface Active Properties of Higher Molecular Weight Betain Lime Soap Dispersants," JAOCS, 56(1979) pp. 771–774 no month available.

W. M. Linfield, "Soap and Lime Soap Dispersants," JAOCS, 55(1978), pp. 87–92 no month available.

W. R. Noble et al., "Soap–Based Detergent Formulations: XXVI. Hard Water Detergency of Soap–Lime Soap Dispersant Combinations with Builders and Inorganic Salts," JAOCS, 57(1980), pp. 368–372 no month available.

J. G. Weers et al., "Effect of the Intramolecular charge separation distance on the solution properties of betaines and sulfobetaines," Langmuir, 1991, vol. 7(5), pp. 854–867. (Abstract Only) no month available.

T. Takeda et al., "Synthesis and properties of a w–bis(amidopropylhydroxysulfobetain)–type amphoteric surfactants," Yukagaku, 1990, vol. 39(8), pp. 576–579. (Abstract Only) no month available.

Chem. Abstract 102(22): 190818t—P. Busch et al., "Hair–conditioning effect of quar hydroxypropyltrimethylammonium chloride. Part I," Parfuem. Kosmet. 1984, 65(11), 692, 694–6, 698 no month available.

Chem. Abstract 192(22): 190819u—P. Busch et al., "Hair–conditioning effect of quar hydroxypropyltrimethylammonium chloride. Part II." Parfuem. Kosmet. 1984, 65(12), 756, 758–60 no month available.

Chem. Abstract 108(1): 5366g—C. A. Bunton, "Micellar effects on nucleophilicity," Adv. Chem. Ser. 1987, 215(Nucleophilicity), 425–41 no month available.

Chem. Abstract 115(6): 56929v—CTFA, Inc., "Final report on the safety assessment of cocamidopropyl betain," J. Am. Coll. Toxicol. 1991, 10(1). 33–52 no month available.

Chem. Abstract 115(14): 138653q—V. Allikmaa, "Highly efficient reversed–phase HPLC studies of amphoteric and cationic amido group containing surfactants," Eesti Tead. Akad. Toim., Keem 1991, 40(1), 67–72 no month available.

Soap–Based Detergent Formulations: XII. "Alternate Syntheses of Surface Active Sulfobetaines", Parris et al., J. Amer. Oil Chem. Soc., vol. 53, Feb. 1976, pp. 60–63.

Zwitterionic Surfactants: Structure and Performance, Fernly, Journal of The Oil Chemists' Society, vol. 55, Jan. 1978, pp. 98–103.
Chem. Abstract 77(12): 77046s—A. Koeber et al., REWO; "Ampholytic cycloimidinium surfactants," Soap, Cosmet., Chem. Spec., 48(5), 86, 88, 193 1972 no month available.
Chem. Abstract 78(2): 5704c—A. Koebner et al., REWO; "Ampholytes," Germ Offen. 10 pp., DE 2063423, published Sep. 21, 1972.
Chem. Abstract 81(11): 63632a—REWO Chemische Fabrik, "Amphoteric quaternary imidazolines useful as surface–active agents," Brit. 8 pp., GB 1,352,770, May 8, 1974.
Chem. Abstract 90(8): 56735u—Hein et al., REWO, "Contribution to the structure of amphoteric surfactant," Fette–Seifen–anstrichm., 80(11), 448–53 1978 no month available.
Chem. Abstract 103(24): 197694d—Hein, REWO; "Surface active derivatives of ricinoleic acid," Fette–Seifen–Anstrichm., 87(7), 283–8 1985 no month available.
Chem. Abstract 105(20): 174830x—Hein, REWO; "Effect of amphoteric surfactants in light–duty detergents," Commun. Jorn. Com. Esp. Deterg., 16, 91–100 1985 no month available.
Chem. Abstract 107(8): 64650x—Zabotto et al., Orea S.A.; "Cosmetic cleansing composition, particularly eye makeup remover," Euro. Pat. Appl., 24 pp., EP 200620 A1, Dec. 10, 1986.
Chem. Abstract 113(21): 188305g—Schmidt et al., Z. Naturforsch., C: Biosci., 45(6) 729–32, "Short–wavelength absorbing complexes of chlorophyll in a micellar solution of cationic detergents" 1990 no month available.
Chem. Abstract 116(4): 131640v—A. Domsch, REWO; "Amphoteric surfactants in detergents and cleaning products," Commun. Jorn. Com. Esp. Deterg., 22, 223–41 1991 no month available.
Brochure: "Soap Scum Removal Using Varion® AM–V," Robert Pifer and James Denison, Sherex Chemical Co., Inc., Form. No. 10/91, 1991.

LIQUID HARD SURFACE DETERGENT COMPOSITIONS CONTAINING SPECIFIC POLYCARBOXYLATE DETERGENT BUILDERS

This is a continuation-in-part of application Ser. No. 08/175832, filed on Dec. 30, 1993 abandoned.

FIELD OF THE INVENTION

This invention pertains to liquid detergent compositions for use in cleaning hard surfaces. Such compositions typically contain detergent surfactants, solvents, builders, etc.

BACKGROUND OF THE INVENTION

The use of solvents and organic water-soluble synthetic detergent surfactants at low levels for cleaning glass are known.

Known liquid detergent compositions comprise certain organic solvents, detergent surfactants, and optional builders and/or abrasives. The prior art, however, fails to teach, or recognize, the advantage of specific builders at critical levels disclosed hereinafter, in liquid hard surface cleaner formulations.

Liquid cleaning compositions have the great advantage that they can be applied to hard surfaces in neat or concentrated form so that a relatively high level of, e.g., surfactant material and/or organic solvent is delivered directly to the soil. Therefore, liquid cleaning compositions have the potential to provide superior soap scum, grease, and oily soil removal over dilute wash solutions prepared from powdered cleaning compositions.

The inclusion of detergent builders in liquid hard surface cleaning compositions increases the potential to provide superior cleaning. However, in the past, the inclusion of such detergent builders has usually produced unacceptable results for filming/streaking. The inclusion of detergent builders has therefore been considered a compromise in favor of cleaning.

Liquid cleaning compositions, and especially compositions prepared for cleaning glass, need exceptionally good filming/streaking properties. In addition, they can suffer problems of product form, in particular, inhomogeneity, lack of clarity, or excessive "solvent" odor for consumer use.

SUMMARY OF THE INVENTION

The present invention relates to an aqueous, liquid, hard surface detergent composition having improved cleaning and good filming/streaking characteristics comprising: (A) detergent surfactant selected from the group consisting of anionic surfactants, amphoteric detergent surfactants including zwitterionic surfactants; and mixtures thereof; (B) hydrophobic solvent; (C) alkaline material; (D) detergent builder selected from the group consisting of ethylenediaminetetraacetic acid, citric acid, N-(2-hydroxyethyl)-iminodiacetic acid, N-(2-hydroxypropyl)-iminodiacetic acid, N-diethyleneglycol-N,N-diacetic acid, carboxymethylsuccinic acid, nitrilotriactetic acid, and mixtures thereof, and (E) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof and any minor ingredients. The compositions can be formulated at usage concentrations, or as concentrates, and can be packaged in a container having means for creating a spray to make application to hard surfaces more convenient.

All percentages, parts, and ratios herein are "by weight" unless otherwise stated.

DETAILED DESCRIPTION OF THE INVENTION

In accordance with the present invention, it has been found that superior aqueous liquid detergent compositions for cleaning shiny surfaces such as glass contain (A) detergent surfactant selected from the group consisting of anionic surfactants, amphoteric detergent surfactants including zwitterionic surfactants; and mixtures thereof; preferably, $C_6$–$C_{10}$ "amphocarboxylate" detergent surfactant, zwitterionic detergent surfactant (containing both cationic and anionic groups in substantially equivalent proportions so as to be electrically neutral at the pH of use), or mixtures thereof; (B) hydrophobic, volatile, cleaning solvent; (C) alkaline buffer, preferably monoethanolamine or certain beta-amino-alkanol compounds as defined hereinafter; (D) critical level of specific polycarboxylate detergent builders such as ethylene diamine tetraacetic acid (EDTA), citric acid, or nitrilotriaeetic acid (NTA) at a pH of at least about 9.5, preferably at least about 10; and 0i) the balance being an aqueous solvent system comprising water and, optionally, non-aqueous polar solvent with only minimal cleaning action selected from the group consisting of methanol, ethanol, isopropanol, ethylene glycol, polypropylene glycol, glycol ethers having a hydrogen bonding parameter of greater than 7.7, and mixtures thereof.

(A) THE DETERGENT SURFACTANT

(1) The Amphocarboxylate Detergent Surfactant

The aqueous, liquid hard surface detergent compositions (cleaners) herein can contain from about 0.001% to about 1%, preferably from about 0.01% to about 0.5%, more preferably from about 0.02% to about 0.2%, and even more preferably from about 0.03% to about 0.08%, of $C_{6-10}$ short chain amphocarboxylate detergent surfactant. It has been found that these amphocarboxylate, and, especially glycinate, detergent surfactants provide good cleaning with superior filming/streaking for detergent compositions that are used to clean both glass and/or relatively hard-to-remove soils. Despite the short chain, the detergency is good and the short chains provide improved filming/streaking, even as compared to most of the zwitterionic detergent surfactants described hereinafter. Depending upon the level of cleaning desired and/or the amount of hydrophobic material in the composition that needs to be solubilized, one can either use only the amphocarboxylate detergent surfactant, or can combine it with cosurfactant, preferably said zwitterionic surfactants.

The "amphocarboxylate" detergent surfactants herein preferably have the generic formula:

$$RN(R^1)(CH_2)_nN(R^2)(CH_2)_pC(O)OM$$

wherein R is a $C_{6-10}$ hydrophobic moiety, typically a fatty acyl moiety containing from about 6 to about 10 carbon atoms which, in combination with the nitrogen atom forms an amido group, $R^1$ is hydrogen (preferably) or a $C_{1-2}$ alkyl group, $R^2$ is a $C_{1-3}$ alkyl or, substituted $C_{1-3}$ alkyl, e.g., hydroxy substituted or carboxy methoxy substituted, preferably, hydroxy ethyl, each n is an integer from 1 to 3, each p is an integer from 1 to 2, preferably 1, and each M is a water-soluble cation, typically an alkali metal, ammonium, and/or alkanolammonium cation. Such detergent surfactants are available, for example: from Witco under the trade name Rewoterie AM-V, having the formula $C_7H_{15}C(O)NH(CH_2)_2N(CH_2CH_2OH)CH_2C(O)O(^-)Na(^+)$;

Mona Industries, under the trade name Monateric 1000, having the formula $C_7H_{15}C(O)NH(CH_2)_2N(CH_2CH_2OH)CH_2CH_2C(O)O(^-)Na(^+)$;

and Lonza under the trade name Amphoterge KJ-2, having the formula $C_{7,9}H_{15,19}C(O)NH(CH_2)_2N(CH_2CH_2OCH_2C(O)O(^-)Na(+))CH_2C(O)O(^-)Na(^+)$.

(2) Zwitterionic Detergent Surfactant

The aqueous, liquid hard surface detergent compositions (cleaners) herein can contain from about 0.02% to about 15% of suitable zwitterionic detergent surfactant containing a cationic group, preferably a quaternary ammonium group, and an anionic group, preferably carboxylate, sulfate and/or sulfonate group, more preferably sulfonate. A more preferred range of zwitterionic detergent surfactant inclusion is from about 0.1% to about 5% of surfactant, a most preferred range is from about 0.02% to about 0.2%.

Zwitterionic detergent surfactants, as mentioned hereinbefore, contain both a cationic group and an anionic group and are in substantial electrical neutrality where the number of anionic charges and cationic charges on the detergent surfactant molecule are substantially the same. Zwitterionic detergents, which typically contain both a quaternary ammonium group and an anionic group selected from sulfonate and carboxylate groups are desirable since they maintain their amphotetic character over most of the pH range of interest for cleaning hard surfaces. The sulfonate group is the preferred anionic group.

Preferred zwitterionic detergent surfactants have the genetic formula:

$R^3$-[C(O)-N($R^4$)-($CR^5_2$)$_n$1]$_m$N($R^6$)$_2$($^+$)-($CR^5_2$)$_p$ 1-Y($^-$)

wherein each Y is preferably a carboxylate ($COO^-$) or sulfonate ($SO_3^-$) group, more preferably sulfonate; wherein each $R^3$ is a hydrocarbon, e.g., an alkyl, or alkylene, group containing from about 8 to about 20, preferably from about 10 to about 18, more preferably from about 12 to about 16 carbon atoms; wherein each ($R^4$) is either hydrogen, or a short chain alkyl, or substituted alkyl, containing from one to about four carbon atoms, preferably groups selected from the group consisting of methyl, ethyl, propyl, hydroxy substituted ethyl or propyl and mixtures thereof, preferably methyl; wherein each ($R^5$) is selected from the group consisting of hydrogen and hydroxy groups with no more than one hydroxy group in any ($CR^5_2$)$p^1$ group; wherein ($R^6$) is like $R^4$ except preferably not hydrogen; wherein m is 0 or 1; and wherein each $n^1$ and $p^1$ are an integer from 1 to about 4, preferably from 2 to about 3, more preferably about 3. The $R^3$ groups can be branched, unsaturated, or both and such structures can provide filming/streaking benefits, even when used as part of a mixture with straight chain alkyl $R^3$ groups. The $R^4$ groups can also be connected to form ring structures such as imidazoline, pyridine, etc. Preferred hydrocarbyl amidoalkylene sulfobetaine (HASB) detergent surfactants wherein m=1 and Y is a sulfonate group provide superior grease soil removal and/or filming/streaking and/or "anti-fogging" and/or perfume solubilization properties. Such hydrocarbylamidoalkylene sulfobetaines, and, to a lesser extent hydrocarbylamidoalkylene betaines are excellent for use in hard surface cleaning detergent compositions, especially those formulated for use on both glass and hard-to-remove soils. They are even better when used with monoethanolamine and/or specific beta-amino alkanol as disclosed herein.

A more preferred specific detergent surfactant is a $C_{10-14}$ fatty acylamidopropylene(hydroxypropylene)sulfobetaine, e.g., the detergent surfactant available from the Witco Company as a 40% active product under the trade name "REWOTERIC AM GAS Sulfobetaine."

The level of zwitterionic detergent surfactant, e.g., HASB, in the composition is typically from about 0.02% to about 15%, preferably from about 0.05% to about 10%. The level in the composition is dependent on the eventual level of dilution to make the wash solution. For glass cleaning, the composition, when used full strength, or wash solution containing the composition, should contain from about 0.02% to about 1%, preferably from about 0.05% to about 0.5%, more preferably from about 0.1% to about 0.25%, of detergent surfactant. For removal of difficult to remove soils like grease, the level can, and should be, higher, typically from about 0.1% to about 10%, preferably from about 0.25% to about 2%. Concentrated products will typically contain from about 0.2% to about 10%, preferably from about 0.3% to about 5%. It is an advantage of the zwitterionic detergent, e.g., HASB, that compositions containing it can be more readily diluted by consumers since it does not interact with hardness cations as readily as conventional anionic detergent surfactants. Zwitterionic detergents are also extremely effective at very low levels, e.g., below about 1%.

Other zwitterionic detergent surfactants are set forth at Col. 4 of U.S. Pat. No. 4,287,080, Siklosi, incorporated herein by reference. Another detailed listing of suitable zwitterionic detergent surfactants for the detergent compositions herein can be found in U.S. Pat. No. 4,557,853, Collins, issued Dec. 10, 1985, incorporated by reference herein. Commercial sources of such surfactants can be found in McCutcheon's EMULSIFIERS AND DETERGENTS, Noah American Edition, 1984, McCutcheon Division, MC Publishing Company, also incorporated herein by reference.

The above patents and references also disclose other detergent surfactants, e.g., anionic, and, less preferably, nonionic detergent surfactants, that can be used in small amounts in the composition of this invention, either as primary surfactants, as discussed hereinafter, or as cosurfactants for the preferred amphoteric/zwitterionic detergent surfactant, the cosurfactant level being small in relation to the primary surfactant. Typical of these are the alkyl- and alkylethoxylate- (polyethoxylate) sulfates, paraffin sulfonates, olefin sulfonates, alkoxylated (especially ethoxylated) alcohols and alkyl phenols, alkyl phenol sulfonates, alpha-sulfonates of fatty acids and of fatty acid esters, and the like, which are well-known from the detergency art. When the pH is above about 9.5, detergent surfactants that are amphoteric at a lower pH are desirable anionic detergent cosurfactants. For example, detergent surfactants which are $C_{12}$–$C_{18}$ acylamido alkylene amino alkylene sulfonates, e.g., compounds having the formula R-C(O)-NH-($C_2H_4$)-N($C_2H_4OH$)-$CH_2CH(OH)CH_2SO_3M$ wherein R is an alkyl group containing from about 9 to about 18 carbon atoms and M is a compatible cation are desirable cosurfactants. These detergent surfactants are available as Miranol CS, OS, JS, etc. The CTFA adopted name for such surfactants is cocoamphohydroxypropyl sulfonate. It is preferred that the compositions be substantially free of alkyl naphthalene sulfonates.

In general, detergent surfactants useful herein contain a hydrophobic group, typically containing an alkyl group in the $C_9$–$C_{18}$ range, and, optionally, one or more linking groups such as ether or amido, preferably amido groups. The anionic detergent surfactants can be used in the form of their sodium, potassium or alkanolammonium, e.g., triethanolammonium salts; the nonionics, not preferred, generally contain from about 5 to about 17 ethylene oxide groups. $C_{12}$–$C_{18}$ paraffin-sulfonates and alkyl sulfates are especially preferred in the compositions of the present type.

Some suitable surfactants for use herein in small amounts are one or more of the following: sodium linear C8-C 18 alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from about 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R^7-\overset{\overset{\displaystyle O}{\|}}{C}-N(R^8)_2$$

wherein $R^7$ is a straight-chain alkyl group containing from about 7 to about 15 carbon atoms and having an average carbon chain length of from about 9 to about 13 carbon atoms and wherein each $R^8$ is a hydroxy alkyl group containing from 1 to about 3 carbon atoms; a zwitterionic surfactant having one of the preferred formulas set forth hereinafter; or a phosphine oxide surfactant. Another suitable class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants can be used.

(3) Anionic Detergent Surfactants

The aqueous, liquid hard surface detergent compositions herein can contain, as the primary detergent surfactant, less preferred, or as the cosurfactant, preferably, from about 0.01% to about 2.0%, more preferably from about 0.1% to about 1.0% of suitable anionic detergent surfactant of the types described hereinbefore. The anionic surfactants are suitably water-soluble alkyl or alkylaryl compounds, the alkyl having from about 6 to about 20 carbons, including a sulfate or sulfonate substituent group. Depending upon the level of cleaning desired one can use only the anionic detergent surfactant, or more preferably the anionic detergent surfactant can be combined with a cosurfactant, preferably a amphoteric cosurfactant. Nonionic surfactants, e.g., ethoxylated alcohols and/or alkyl phenols, can also be used as cosurfactants.

The anionic detergent surfactants herein preferably have the generic formula:

$R^9$-$(R^{10})_{0-1}$-$SO_3(^-)M(^+)$ wherein $R^9$ is a $C_6$–$C_{20}$ alkyl chain, preferably a $C_8$–$C_{16}$ alkyl chain; $R^{10}$, when present, is a $C_6$–$C_{20}$ alkylene chain, preferably a $C_8$–$C_{16}$ alkylene chain, a $C_6H_4$ phenylene group, or O; and M is the same as before.

(4) Mixtures

Mixtures of amphocarboxylate, zwitterionic detergent surfactants, and/or anionic detergent surfactants as discussed hereinbefore, can be present in the present invention. The zwitterionic detergent surfactants can be present at levels from about 0.02% to about 15%. The amphocarboxylate detergent surfactants can be present at levels from about 0.001% to about 15%. The ratio of zwitterionic detergent surfactant to amphocarboxylate detergent surfactant is from about 3:1 to about 1:3, preferably from about 2:1 to about 1:2, more preferably the ratio is about 1:1. The ratio of primary detergent surfactant to cosurfactant or cosurfactants is from about 3:1 to about 1:1.

B. HYDROPHOBIC SOLVENT

In order to obtain good cleaning one can use a hydrophobic solvent that has cleaning activity. The solvents employed in the hard surface cleaning compositions herein can be any of the well-known "degreasing" solvents commonly used in, for example, the dry cleaning industry, in the hard surface cleaner industry and the metalworking industry.

A useful definition of such solvents can be derived from the solubility parameters as set forth in "The Hoy," a publication of Union Carbide, incorporated herein by reference. The most useful parameter appears to be the hydrogen bonding parameter which is calculated by the formula:

$$\gamma H = \gamma T \left[ \frac{a-1}{a} \right]^{1/2}$$

wherein δH is the hydrogen bonding parameter, a is the aggregation number, (Logα=3.39066 $T_b/T_c$–0.15848–Log M/d), and δT is the solubility parameter which is obtained from the formula:

$$\gamma T = \left[ \frac{(\Delta H_{25} - RT)d}{M} \right]^{1/2}$$

where $\Delta H_{25}$ is the heat of vaporization at 25° C., R is the gas constant (1.987 cal/mole/deg), T is the absolute temperature in °K, $T_b$ is the boiling point in °K, $T_c$ is the critical temperature in °K, d is the density in g/ml, and M is the molecular weight.

For the compositions herein, hydrogen bonding parameters are preferably less than about 7.7, more preferably from about 2 to about 7 or 7.7, and even more preferably from about 3 to about 6. Solvents with lower numbers become increasingly difficult to solubilize in the compositions and have a greater tendency to cause a haze on glass. Higher numbers require more solvent to provide good greasy/oily soil cleaning.

Hydrophobic solvents are typically used at a level of from about 0.5% to about 30%, preferably from about 2% to about 15%, more preferably from about 4% to about 8%. Dilute compositions typically have solvents at a level of from about 1% to about 10%, preferably from about 3% to about 6%. Concentrated compositions contain from about 10% to about 30%, preferably from about 10% to about 20% of solvent.

More hydrophobic solvents such as, hydrocarbons and mono and/or disesquiterpenes should not be present at a level of more than about 0.4%, by weight of the composition, and preferably, the composition is essentially free of said solvents, especially when they have limited volatility. Many of such solvents comprise hydrocarbon or halogenated hydrocarbon moieties of the alkyl or cycloalkyl type, and have a boiling point well above room temperature, i.e., above about 20° C.

The formulator of compositions of the present type will be guided in the selection of co-solvent partly by the need to provide good grease-cutting properties, and partly by aesthetic considerations. For example, kerosene hydrocarbons function quite well for grease cutting in the present compositions, but can be malodorous. Kerosene must be exceptionally clean before it can be used, even in commercial situations. For home use, where malodors would not be tolerated, the formulator would be more likely to select solvents which have a relatively pleasant odor, or odors which can be reasonably modified by perfuming.

The $C_6$–$C_9$ alkyl aromatic solvents, especially the $C_6$–$C_9$ alkyl benzenes, preferably octyl benzene, exhibit excellent grease removal properties and have a low, pleasant odor. Likewise, the olefin solvents having a boiling point of at least about 100° C., especially alpha-olefins, preferably 1-decene or 1-dodecene, are excellent grease removal solvents. However, the compositions are preferably essentially free of these very hydrophobic solvents.

Generically, the glycol ethers useful herein have the formula $R^{11}$ O-$(R^{12}O)_m$1H wherein each $R^{11}$ is an alkyl group which contains from about 3 to about 8 carbon atoms, each $R^{12}$ is either ethylene or propylene, and $m^1$ is a number from 1 to about 3. The most preferred glycol ethers are selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonohexyl ether, monoethyleneglycolmonobutyl ether, and mixtures thereof.

A particularly preferred type of solvent for these hard surface cleaner compositions comprises diols having from 6 to about 16 carbon atoms in their molecular structure. Preferred diol solvents have a solubility in water of from about 0.1 to about 20 g/100 g of water at 20° C.

Solvents such as pine oil, orange terpene, benzyl alcohol, n-hexanol, phthalic acid esters of $C_{1-4}$ alcohols, butoxy propanol, Butyl Carbitol R and 1 (2-n-butoxy-1-methylethoxy)propane- 2-ol (also called butoxy propoxy propanol or dipropylene glycol monobutyl ether), hexyl diglycol (Hexyl Carbitol R), butyl triglycol, diols such as 2,2,4-trimethyl-1,3-pentanediol, and mixtures thereof, can be used although the levels of hydrophobic material such as pine oil and orange terpene should be kept very low, if present. The butoxy-propanol solvent should have no more than about 20%, preferably no more than about 10%, more preferably no more than about 7%, of the secondary isomer in which the butoxy group is attached to the secondary atom of the propanol for improved odor.

C. ALKALINITY SOURCE

The aqueous liquid hard surface compositions can contain herein from about 0.05 % to about 10%, by weight of the composition, of alkaline material, preferably comprising or consisting essentially of, monoethanolamine and/or betaaminoalkanol compounds.

Monoethanolamine and/or beta-aminoalkanol compounds serve primarily as solvents when the pH is above about 10.0, and especially above about 10.7. They also provide alkaline buffering capacity during use. However, the most unique contribution they make is to improve the filming/streaking properties of hard surface cleaning compositions containing zwitterionic detergent surfactant, amphocarboxylate detergent surfactant, or mixtures thereof, whereas they do not provide any substantial improvement in filming/streaking when used with conventional anionic or ethoxylated nonionic detergent surfactants. The reason for the improvement is not known. It is not simply a pH effect, since the improvement is not seen with conventional alkalinity sources. Other similar materials that are solvents do not provide the same benefit and the effect can be different depending upon the other materials present. When perfumes that have a high percentage of terpenes are incorporated, the benefit is greater for the beta-alkanolamines, and they are often preferred, whereas the monoethanolamine is usually preferred.

Monoethanolamine and/or beta-alkanolamine are used at a level of from about 0.05% to about 10%, preferably from about 0.2% to about 5%. For dilute compositions they are typically present at a level of from about 0.05% to about 2%, preferably from about 0.1% to about 1.0%, more preferably from about 0.2% to about 0.7%. For concentrated compositions they are typically present at a level of from about 0.5% to about 10%, preferably from about 1% to about 5%.

Preferred beta-aminoalkanols have a primary hydroxy group. Suitable betaaminoalkanols have the formula:

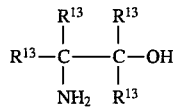

wherein each $R^{13}$ is selected from the group consisting of hydrogen and alkyl groups containing from one to four carbon atoms and the total of carbon atoms in the compound is from three to six, preferably four. The amine group is preferably not attached to a primary carbon atom. More preferably the amine group is attached to a tertiary carbon atom to minimize the reactivity of the amine group. Specific preferred beta-aminoalkanols are 2-amino, 1-butanol; 2-amino,2-methylpropanol; and mixtures thereof. The most preferred beta-aminoalkanol is 2-amino,2-methylpropanol since it has the lowest molecular weight of any beta-aminoalkanol which has the amine group attached to a tertiary carbon atom. The beta-aminoalkanols preferably have boiling points below about 175° C. Preferably, the boiling point is within about 5° C. of 165° C.

Such beta-aminoalkanols are excellent materials for hard surface cleaning in general and, in the present application, have certain desirable characteristics.

The beta-aminoalkanols are surprisingly better than, e.g., monoethanolamine for hard surface detergent compositions that contain perfume ingredients like terpenes and similar materials. However, normally the monoethanolamine is preferred for its effect in improving the filming/streaking performance of compositions containing zwitterionic detergent surfactant. The improvement in filming/streaking of hard surfaces that is achieved by combining the monoethanolamine and/or beta-aminoalkanol was totally unexpected.

Good filming/streaking, i.e., minimal, or no, filming/streaking, is especially important for cleaning of, e.g., window glass or mirrors where vision is affected and for dishes and ceramic surfaces where spots are aesthetically undesirable. Beta-aminoalkanols provide superior cleaning of hard-to-remove greasy soils and superior product stability, especially under high temperature conditions, when used in hard surface cleaning compositions, especially those containing the zwitterionic detergent surfactants.

Beta-aminoalkanols, and especially the preferred 2-amino-2-methylpropanol, are surprisingly volatile from cleaned surfaces considering their relatively high molecular weights.

The compositions can contain, either alone or in addition to the preferred alkanolamines, more conventional alkaline buffers such as ammonia; other $C_{2-4}$ alkanolamines; alkali metal hydroxides; silicates; borates; carbonates; and/or bicarbonates. Thus, the buffers that are present usually comprise the preferred monoethanolamine and/or beta-aminoalkanol and additional conventional alkaline material. The total amount of alkalinity source is typically from 0% to about 5%, preferably from 0% to about 0.5%, to give a pH in the product, at least initially, in use of from about 9.5 to about 12, preferably from about 9.7 to about 11.5, more preferably from about 9.7 to about 11.3. pH is usually measured on the product.

(D) DETERGENT BUILDER

Detergent builders that are efficient for hard surface cleaners and have reduced filming/streaking characteristics at the critical levels are an essential element of the present invention. Addition of specific detergent builders at critical levels to the present composition improves cleaning without the problem of filming/streaking that usually occurs when detergent builders are added to hard surface cleaners. Through the present invention there is no longer the need to make a compromise between improved cleaning and acceptable filming/streaking results which is especially important for hard surface cleaners which are also directed at cleaning glass. These compositions containing the detergent builders herein at the levels herein, have exceptionally good cleaning properties. They also have exceptionally good "shine" properties, i.e., when used to clean glossy surfaces, without rinsing, they have much less tendency than, e.g., carbonate built products to leave a dull finish on the surface and filming/streaking.

Suitable detergent builders include salts of ethylenediaminetetraacetic acid (hereinafter EDTA), citric acid, nitrilotriacetic acid (hereinafter NTA), sodium carboxymethylsuccinic acid, sodium N-(2-hydroxypropyl)-iminodiacetie acid, tartaric acid, and N-diethyleneglycol-N,N-diacetic acid (hereinafter DIDA). The salts are preferably compatible and include ammonium, sodium, potassium and/or alkanolammonium salts. The alkanolammonium salt is preferred as described hereinafter. A preferred detergent builder is NTA (e.g., sodium), a more preferred builder is citrate (e.g., sodium or monoethanolamine), an even more preferred builder is tartaric acid, and a most preferred builder is EDTA (e.g., sodium).

The detergent builders are present at levels of from about 0.05 % to about 0.5%. more preferably from about 0.05% to about 0.3%, most preferably from about 0.05% to about 0.15 %. The levels of builders present in the wash solution used for glass should be less than about 0.2%. Therefore, typically, dilution is highly preferred for cleaning glass, while full strength is preferred for general purpose cleaning, depending on the concentration of the product.

Typically the improvement with regard to acceptable filming/streaking results occurs most when the builder is combined with amphoteric and/or zwitterionic detergent surfactant compositions although an improvement is also seen with the less preferred anionic or anionic/nonionic detergent surfactant compositions.

(E) AQUEOUS CO-SOLVENT SYSTEM

The balance of the formula is typically water and non-aqueous polar solvents with only minimal cleaning action, having hydrogen bonding parameters greater than about 7.7, preferably greater than about 7.8, like methanol, ethanol, isopropanol, ethylene glycol, glycol ethers having a hydrogen bonding parameter of greater than 7.7, propylene glycol, and mixtures thereof, preferably isopropanol, more preferably ethanol. The level of non-aqueous polar solvent is usually greater when more concentrated formulas are prepared. Typically, the level of non-aqueous polar solvent is from about 0.5% to about 40%, preferably from about 1% to about 10%, more preferably from about 2% to about 8% (especially for "dilute" compositions) and the level of water is from about 50% to about 99%, preferably from about 75% to about 95%.

(F) OPTIONAL INGREDIENTS

The compositions herein can also contain other various adjuncts which are known to the art for detergent compositions. Preferably they are not used at levels that cause unacceptable filming/streaking. Non-limiting examples of such adjuncts are:

Enzymes such as proteases;

Hydrotropes such as sodium toluene sulfonate, sodium cumene sulfonate and potassium xylene sulfonate; and Aesthetic-enhancing ingredients such as colorants and perfumes, providing they do not adversely impact on filming/streaking in the cleaning of glass. Most hard surface cleaner products contain some perfume to provide an olfactory aesthetic benefit and to cover any "chemical" odor that the product may have. The main function of a small fraction of the highly volatile, low boiling (having low boiling points), perfume components in these perfumes is to improve the fragrance odor of the product itself, rather than impacting on the subsequent odor of the surface being cleaned. However, some of the less volatile, high boiling perfume ingredients can provide a fresh and clean impression to the surfaces, and it is sometimes desirable that these ingredients be deposited and present on the dry surface. The perfumes are preferably those that are more water-soluble and/or volatile to minimize spotting and filming. The perfumes useful herein are described in more detail in U.S. Pat. No. 5,108,660, Michael, issued Apr. 28, 1992, at col. 8 lines 48 to 68, and col. 9 lines 1 to 68, and col. 10 lines 1 to 24, said patent, and especially said specific portion, being incorporated by reference. Antibacterial agents can be present, but preferably only at low levels to avoid filming/streaking problems. More hydrophobic antibacterial/germicidal agents, like orthobenzyl-para-chlorophenol, are avoided. If present, such materials should be kept at levels below about 0.1%.

Stabilizing ingredients can be present typically to stabilize more of the hydrophobic ingredients, e.g., perfume. The stabilizing ingredients include acetic acid and propionic acids, and their salts, e.g., $NH_4$, MEA, Na, K, etc., preferably acetic acid and the $C_2$–$C_6$ alkane diols, more preferably butane diol. The stabilizing ingredients do not function in accordance with any known principle. Nonetheless, the combination of amido zwitterionic detergent surfactant with linear acyl amphocarboxylate detergent surfactant, anionic detergent surfactant, nonionic detergent surfactant, or mixtures thereof, and stabilizing ingredient can create a microemulsion. The amount of stabilizing ingredient is typically from about 0.01% to about 0.5%, preferably from about 0.02% to about 0.2%. The ratio of hydrophobic material, e.g., perfume that can be stabilized in the product is related to the total surfactant and typically is in an amount that provides a ratio of surfactant to hydrophobic material of from about 1:2 to about 2:1.

Concentrated compositions of the present invention can also be used in order to provide a less expensive and more ecologically sound product. Concentrations of up to 10× the original concentration, preferably up to 5×, more preferably up to 2× the original concentration can be used and can be diluted using tap water, distilled water, and/or deionized water, down to a 1× concentration.

The invention is illustrated by the following nonlimiting Examples.

Filming/Streaking Stress Test

Procedure:

A paper towel is folded into eighths. Two milliliters of test product are applied to the upper half of the folded paper towel. The wetted towel is applied in one motion with even pressure from top to bottom of a previously cleaned window or mirror. The window or mirror with the applied product(s) is allowed to dry for ten minutes before grading by expert judges. After initial grading, the residues are then buffed with a dry paper towel with a uniform, consistent motion. The buffed residues are then graded by expert judges.

Grading:

Expert judges are employed to evaluate the specific areas of product application for amount of filming/streaking. A numerical value describing the amount of filming/streaking is assigned to each product. For the test results reported here a 0–6 scale is used.

0=No Filming/Streaking

6=Poor Filming/Streaking

Room temperature and humidity have been shown to influence filming/streaking.

Therefore, these variables are always recorded.

EXAMPLE I

| Ingredient | Formula No. (Wt. %) 1 | 2 | 3 | 4 | 5 | 6 |
|---|---|---|---|---|---|---|
| IPA[1] | 6.0 | 6.0 | 6.0 | 6.0 | 6.0 | 6.0 |
| BP[2] | 3.0 | 3.0 | 3.0 | 3.0 | 3.0 | 3.0 |
| MEA[3] | 0.50 | 0.50 | 0.50 | 0.50 | 0.50 | 0.50 |
| Cocoamidopropyl-hydroxy-sultaine | 0.16 | 0.16 | 0.16 | 0.16 | 0.16 | 0.16 |
| Sodium Lauryl Sulfate | 0.02 | 0.02 | 0.02 | 0.02 | 0.02 | 0.02 |
| EDTA[4] | — | 0.05 | 0.10 | 0.25 | 0.50 | 1.0 |
| Perfume | 0.13 | 0.13 | 0.13 | 0.13 | 0.13 | 0.13 |
| Soft Water to Balance | ← BALANCE → | | | | | |

[1]Isopropanol
[2]Butoxypropanol
[3]Monoethanolamine
[4]Ethylene diamine tetraacetic acid Filming/Streaking Stress Test on Glass Windows
(Four Replications at 73° F. and 32% Relative Humidity)

| Formula No. | Before/After Buffing Rating |
|---|---|
| 1 | 2.3/2.6 |
| 2 | 2.5/0.3 |
| 3 | 1.8/0.5 |
| 4 | 2.0/0.5 |
| 5 | 2.8/1.4 |
| 6 | 3.4/2.8 |

The least significant difference between before buffing mean ratings is 0.9 at 95% confidence level. The least significant difference between after buffing mean ratings is 0.4 at 95% confidence level.

The above shows that the addition of detergent builders at critical levels does not cause unacceptable filming/streaking results, and in some cases actually improves filming/streaking results, especially after buffing if the level of detergent builder is 0.5% or less.

EXAMPLE II

| Ingredient | Formula No. (Wt. %) 1 | 2 | 3 | 4 | 5 | 6 |
|---|---|---|---|---|---|---|
| IPA | 5.4 | 5.4 | 2.0 | 2.0 | 2.0 | 2.0 |
| MEA | 0.4 | 0.4 | 0.5 | 0.5 | 0.5 | 0.5 |
| BP | — | — | 3.0 | 3.0 | 3.0 | 3.0 |
| Ethylene Glycol Monohexyl Ether | 0.9 | 0.9 | — | — | — | — |
| Ethylene Glycol Monobutyl Ether | 1.0 | 1.0 | — | — | — | — |
| LAS[5] | 0.07 | 0.07 | — | — | — | — |
| Sodium Lauryl Sulfate | — | — | — | — | 0.1 | 0.1 |
| $C_9$ Alkylphenolethoxylate | 0.03 | 0.03 | — | — | — | — |
| $C_8$ Alkylphenolethoxylate | — | — | 0.1 | 0.1 | — | — |
| EDTA | — | 0.1 | — | 0.1 | — | 0.1 |
| Ammonia | 0.1 | 0.1 | — | — | — | — |
| Deionized (DI) Water to Balance | ← BALANCE → | | | | | |

[5]Linear alkyl benzene sulfonate

Filming/Streaking Stress Test on Glass
(Four Replications at 79° F. and 36% Relative Humidity)

| Formula No. | Before/After Buffing Rating |
|---|---|
| 1 | 2.8/0.12 |
| 2 | 3.3/0.38 |
| 3 | 4.7/4.5 |
| 4 | 5.2/4.4 |
| 5 | 2.9/1.4 |
| 6 | 3.25/2.3 |

The least significant difference, in the above example, between before buffing mean ratings is 0.3 at 95% confidence level. The least significant difference between after buffing mean ratings is 0.4 at 95% confidence level.

EXAMPLE III

| Ingredient | Formula No. (Wt. %) 1 | 2 | 3 |
|---|---|---|---|
| IPA | 6.0 | 6.0 | 6.0 |
| BP | 3.0 | 3.0 | 3.0 |
| MEA | 0.50 | 0.50 | 0.50 |
| Cocoamidopropylhydroxy Sultaine | 0.16 | 0.16 | 0.16 |
| Sodium Lauryl Sulfate | 0.02 | 0.02 | 0.02 |
| Sodium Carbonate | — | — | 0.06 |
| EDTA | — | 0.1 | — |
| Perfume | 0.13 | 0.13 | 0.13 |
| Soft Water to Balance | ← BALANCE → | | |

Filming/Streaking Stress Test on Glass
(Four Replications at 73° F. and 29% Relative Humidity)

| Formula No. | Before/After Buffing Rating |
|---|---|
| 1 | 2.0/2.9 |
| 2 | 2.4/1.0 |
| 3 | 4.5/0.6 |

The least significant difference, in the above example, between before buffing mean ratings is 1.04 at 95% confidence level. The least significant difference between after buffing mean ratings is 0.49 at 95% confidence level.

The above example shows that initially carbonate leaves an unacceptable filming/streaking appearance and that more work, i.e., buffing must be done in order to obtain an acceptable result with carbonate whereas the EDTA leaves an acceptable appearance both before and after buffing.

The following test is used to evaluate the compositions' cleaning performance.

Preparation of Soiled Panels

Enamel splash panels are selected and cleaned with a mild, light duty liquid cleanser, then cleaned with isopropanol, and rinsed with distilled or deionized water. Greasy-particulate soil is weighed (2.0 grams) and placed on a sheet of aluminum foil. The greasy-particulate soil is a mixture of about 77.8% commercial vegetable oils and about 22.2% particulate soil composed of humus, fine cement, clay, ferrous oxide, and carbon black. The soil is spread out with a spatula and rolled to uniformity with a small roller. The uniform soil is then rolled onto the clean enamel plates until an even coating is achieved. The panels are then equilibrated in air and then placed in a preheated oven and baked at 140° C. for 45–60 minutes. Panels are allowed to cool to room temperature and can either be used immediately, or aged for one or more days. The aging produces a tougher soil that typically requires more cleaning effort to remove.

Soil Removal

A Gardner Straight Line Washability Machine is used to perform the soil removal. The machine is fitted with a carriage which holds the weighted cleaning implement. The cleaning implements used for this test were clean cut sponges. Excess water is wrung out from the sponge and 5.0 grams of product are uniformly applied to one surface of the sponge. The sponge is fitted into the carriage on the Gardner machine and the cleaning test is run.

The average number of Gardner machine strokes necessary to achieve 95–99% removal of soil are obtained.

EXAMPLE IV

| | Formula No. (Wt. %) | | | | | |
|---|---|---|---|---|---|---|
| Ingredient | 1 | 2 | 3 | 4 | 5 | 6 |
| IPA | 6.0 | 6.0 | 5.4 | 2.0 | 2.0 | 2.0 |
| BP | 3.0 | 3.0 | — | 3.0 | 3.0 | 3.0 |
| MEA | 0.50 | 0.50 | 0.40 | 0.50 | 0.50 | 0.50 |
| Cocoamido-propylhydroxy sultaine | 0.16 | 0.16 | — | 0.075 | 0.075 | 0.075 |
| Sodium Lauryl Sulfate | 0.02 | 0.02 | — | — | — | — |
| Ethyleneglycol-monohexyl ether | — | — | 0.90 | — | — | — |
| Ethyleneglycol-monobutyl ether | — | — | 1.0 | — | — | — |
| LAS | — | — | 0.07 | — | — | — |
| $C_9$ Alkylphenol-ethoxylate | — | — | 0.03 | — | — | — |
| $C_{8,10}$-carboxy-methoxyglycinate | — | — | — | 0.075 | 0.075 | — |
| $C_{8,10}$-hydroxy-methylglycinate | — | — | — | — | — | 0.075 |
| Sodium Acetate | — | — | — | 0.05 | 0.05 | 0.05 |
| Ammonia | — | — | 0.10 | — | — | — |
| EDTA | — | 0.1 | — | — | — | — |
| Perfume | 0.13 | 0.13 | unknon | 0.11 | 0.13 | 0.11 |
| Soft Water to Balance | ← BALANCE → | | | | | |

| Formula No. | Average Number of Strokes |
|---|---|
| 1 | 7.5 |
| 2 | 5.5 |
| 3 | 7.5 |
| 4 | 6.5 |
| 5 | 6.0 |
| 6 | 6.5 |

*Two replicates, greasy-particulate soil.

The above shows the cleaning improvement when a detergent builder is added to the composition. There is a cleaning benefit from adding as little as 0.1% EDTA detergent builder to a composition containing either a zwitterionic or cosurfactant-surfactant mixture.

There is a plus/minus one stroke difference between strokes at the 95% confidence level.

EXAMPLE V

| | Formula No. (Wt. %) | |
|---|---|---|
| Ingredients | 1 | 2 |
| Ethanol | 1.5 | 17.00 |
| Butoxypropanol | 3.2 | 16.00 |
| Monoethanolamine | 0.5 | 2.50 |
| Cocoamidohydroxypropyl Sulfobetaine | 0.16 | 0.80 |
| Tartaric acid | 0.06 | 0.30 |
| Perfume | 0.02 | 0.10 |
| Dyes | 0.0005 | 0.003 |
| Water | Balance | Balance |

What is claimed is:

1. An aqueous liquid hard surface detergent composition having excellent filming/streaking characteristics, comprising:

(A1) from about 0.02%–1.0%, by weight of the composition, of detergent surfactant having the generic formula:

$R^3$-[C(O)-N-($R^4$)($CH_2$)$_n$]-N($CH_3$)$_2^{(+)}$-($CR^5$)$_3$-$SO_3^{(-)}$ wherein $R^3$ is an alkyl or alkylene group containing from about 10 to 15 carbon atoms; $R^4$ is selected from the group consisting of hydrogen, methyl, ethyl, propyl, hydroxyl substituted ethyl or propyl and mixtures thereof; each $R^5$ is selected from the group consisting of hydrogen and hydroxy groups wherein one of the $R^5$ groups between the (+) and the (–) charge centers is a hydroxy group and the remaining $R^5$ groups are hydrogen with no more than one hydroxy group in the ($CR^5{}_2$)$_3$ moiety and n is a number from 1 to about 4;

(A2) from about 0.01 to about 1.0%, by weight of the composition, of a $C_{12}$–$C_{18}$ alkyl sulfate detergent surfactant;

(B) from about 2% to about 15%, by weight of the composition, of hydrophobic solvent, having a hydrogen bonding parameter of from about 2 to about 7.7, wherein said solvent comprises no more than about 0.4%, by weight of the composition of mono or sequiterpenes;

(C) from about 0.05% to about 10%, by weight of the composition, of alkaline material;

(D) from about 0.05% to about 0.5%, by weight of the composition, of detergent builder selected from the group consisting of water soluble salts of ethylenediaminetetraacetic acid; and (E) the balance being an aqueous co-solvent system comprising any organic co-solvent having a hydrogen bonding parameter of greater than about 7.8.

2. The composition of claim 1 wherein said alkaline material is an alkanolamine selected from the group consisting of monoethanolamine; beta-amino-alkanol, containing from about three to about six carbons; and mixtures thereof, and is present in amounts sufficient to give a pH of from about 9.5 to about 12.

3. The composition of claim 1 wherein said solvent (B) is selected from the group consisting of monopropyleneglycolmonopropyl ether, dipropyleneglycolmonobutyl ether, monopropyleneglycolmonobutyl ether, ethyleneglycolmonohexyl ether, ethyleneglycolmonobutyl ether, diethyleneglycolmonohexyl ether, monoethyleneglycolmonobutyl ether, and mixtures thereof.

4. The composition of claim 3 wherein said solvent (B) is monopropyleneglycolmonobutyl ether.

5. The composition of claim 2 wherein said alkaline material is monoethanolamine and wherein the pH of said composition is from about 9.7 to about 12.

6. The composition of claim 1 wherein said alkaline material is an alkali metal hydroxide and wherein said composition has a pH of from about 9.7 to about 11.3.

7. The composition of claim 1 wherein said detergent builder (D) is present at a level of from about 0.05% to about 0.3% by weight of the composition.

8. The composition of claim 7 wherein the level of said builder is from about 0.05% to about 0.15%, by weight of the composition.

* * * * *